US009656141B2

(12) United States Patent
Redmond et al.

(10) Patent No.: US 9,656,141 B2
(45) Date of Patent: May 23, 2017

(54) DEVICE FOR FINGER PROTECTION IN MARTIAL ARTS

(71) Applicants: Steven Douglas Redmond, Boise, ID (US); Karen Ann Redmond, Boise, ID (US)

(72) Inventors: Steven Douglas Redmond, Boise, ID (US); Karen Ann Redmond, Boise, ID (US)

( * ) Notice: Subject to any disclaimer, the term of this patent is extended or adjusted under 35 U.S.C. 154(b) by 890 days.

(21) Appl. No.: 14/027,022

(22) Filed: Sep. 13, 2013

(65) Prior Publication Data

US 2015/0080193 A1 Mar. 19, 2015
US 2016/0250537 A9 Sep. 1, 2016

Related U.S. Application Data

(60) Provisional application No. 61/701,387, filed on Sep. 14, 2012, provisional application No. 61/770,228, filed on Feb. 27, 2013.

(51) Int. Cl.
*A63B 69/34* (2006.01)
*A41D 13/08* (2006.01)
(Continued)

(52) U.S. Cl.
CPC ..... *A63B 69/004* (2013.01); *A63B 71/14* (2013.01); *A63B 2069/0042* (2013.01); *Y10T 16/44* (2015.01)

(58) Field of Classification Search
CPC ..... A63B 60/10; A63B 60/12; A63B 60/40; A63B 69/004; A63B 69/20;
(Continued)

(56) References Cited

U.S. PATENT DOCUMENTS 2,717,799 A 9/1955 Jones
2,923,946 A 2/1960 Nielsen
(Continued)

OTHER PUBLICATIONS

Introducing The Board Breaker, http://www.theboardbreaker.com/, printed Jun. 28, 2012, p. 1-3.
(Continued)

*Primary Examiner* — Sundhara Ganesan
*Assistant Examiner* — Nyca T Nguyen
(74) *Attorney, Agent, or Firm* — Pedersen and Company, PLLC; Ken J. Pedersen; Barbara S. Pedersen

(57) ABSTRACT

A protection device for a holder of a martial arts board/target provides protection from direct impact and/or from the force/shock that is transmitted rearward to the hand and wrists of the holder of the board/target. The device receives the board/target holder's fingers, and a slanted floor inside the device urges the fingers into a generally curled or other inwardly-slanted position, and urges the rest of the hand, the wrist, and forearm into ergonomic and safer positions. The device is preferably made of material(s) in a particular hardness range that protects the user's fingers but that also prevents injury to the striker who is hitting/kicking the board/target. There are preferably no flanges or stops that limit placement of the device to particular places on the board, but rather the holder determines and controls the placement.

17 Claims, 9 Drawing Sheets

(51) Int. Cl.
*A63B 69/00* (2006.01)
*A63B 71/14* (2006.01)

(58) Field of Classification Search
CPC ..... A63B 2069/1042; A63B 71/14; A63B 71/141; A63B 69/34; A63B 2069/0042; A41D 13/08; A41D 13/081; A41D 13/082; A41D 13/087; A41D 260/20; A41D 294/25; B25B 3/00; B25B 5/082; B25B 5/101; B25B 5/125; B25B 9/00
USPC ..... 482/83; 248/11.5, 118.5; 294/25; 2/16, 2/20, 21, 161.6, 163
See application file for complete search history.

(56) References Cited

U.S. PATENT DOCUMENTS 3,228,033 A 1/1966 Ames et al.
3,496,573 A * 2/1970 Pope ..... A63B 71/148 2/16
3,903,546 A 9/1975 Rhee
4,400,829 A 8/1983 Willis
4,497,073 A 2/1985 Deutsch
4,635,300 A 1/1987 Rhee
4,776,584 A * 10/1988 Tilley ..... A63B 69/004 294/131
4,807,302 A * 2/1989 Cannella ..... A63B 71/145 2/16
4,908,881 A 3/1990 Field
4,977,621 A * 12/1990 Richard ..... A41D 13/082 2/161.1
5,136,725 A * 8/1992 Montero ..... A63B 71/148 2/16
D338,742 S 8/1993 Cherepanov
5,232,368 A * 8/1993 Morgia ..... A63B 69/20 273/DIG. 30
5,274,846 A 1/1994 Kolsky
5,343,562 A 9/1994 Bible
5,458,564 A 10/1995 Franzen
5,566,390 A 10/1996 Clancy
5,595,518 A * 1/1997 Ours ..... A63B 31/11 264/244
5,983,408 A 11/1999 Li
6,219,843 B1 4/2001 Passi et al.
6,240,558 B1 6/2001 Makris et al.
6,612,632 B2 * 9/2003 Campbell ..... E02F 3/02 294/25
6,711,747 B2 3/2004 Carlin
7,165,270 B2 * 1/2007 DeYoung ..... A41D 13/087 2/16
7,207,928 B2 4/2007 Arrington
7,296,300 B2 11/2007 Votolato
7,299,506 B1 11/2007 Samaroo
8,037,549 B2 10/2011 Saur et al.
D651,356 S 12/2011 Logan et al.
D651,357 S 12/2011 Logan
8,087,101 B2 1/2012 Ferguson
D657,095 S 4/2012 Logan
8,844,080 B2 * 9/2014 Stacy ..... A47J 43/28 2/163

OTHER PUBLICATIONS

Various Breaking Board Holders. Superior Martial Arts Supplies, http://superiormartialarts.com/cgi-bin/uniform/perlshop.cgi?ACTION=thispage&thispage= . . . , printed Jun. 28, 2012, pp. 1-7.
Board Breaker, Century, http://www.centurymartialarts.com/Targets_and_Shields/Targets/Board_Breaker.aspx, printed Jun. 28, 2012.
Present Applicant's portrayal of commercial product similar to Cannella U.S. Pat. No. 4,807,302, excerpt from "prior art" drawings in present application, commercial product available prior to Sep. 2012.

* cited by examiner

DEVICE FOR FINGER PROTECTION IN MARTIAL ARTS

This application claims benefit of Provisional Application Ser. No. 61/701,387, filed Sep. 14, 2012 and entitled "Finger Armor", and Provisional Application Ser. No. 61/770,228, filed Feb. 27, 2013 and entitled "Device for protecting hands in martial arts", the disclosures of both applications being incorporated herein by this reference.

BACKGROUND OF THE INVENTION

Martial artists use board breaking as a method to demonstrate various attributes such as proper technique, power, targeting and speed among others. Board breaking is used in rank advancement testing, competitions, and even setting Guinness™ world records. Breaking boards requires one or more fellow students to hold the board (referred to as "holders") for the student performing the technique (referred to as a "breaker"). While hand techniques are usually very accurate, foot techniques used in board breaking are usually not very accurate. High speed breaking techniques, particularly kicks, can cause noticeable injury to the target board holder's(s') hands and fingers due to poor targeting by the breaker. Once struck/injured, a holder is likely to "flinch" or move the board/target on subsequent attempts, increasing the difficulty of successfully breaking the board/target.

Prior art attempts at providing some hand protection have been generally unsuccessful, for example, benefitted only the holder, or compromising between benefitting the breaker and benefitting the holder to the point that neither attempt at protection has worked. A prior art attempt at providing hand protection is illustrated by the sheath (12) in U.S. Pat. No. 4,807,302 by Cannella. A prior art product very similar to the disclosure of Cannella, and marked in the past with the Cannella patent number, has been and is commercially available, but it does not include the spikes 14 shown in the Cannella drawings. Other prior art attempts at hand protection include the holders' wearing of padded gloves.

Increased Chance of Injury:

The inventors believe, in order to avoid or minimize the chance of injury, a holder should hold a board/target with the hand and fingers generally in the position shown by the bare-hand portrayal in FIG. 1A. This places the metacarpophalangeal joints ("knuckles" K) directly adjacent to (directly above in the drawing) the edge of the board B and at or very close to the central plane CP of the board. Further, the inventors prefer that the hand and forearm lie in positions wherein the heel H of the palm is slightly distanced from the board (see P1) and closer to the outer perimeter edge E of the board, rather than being closer to the central region CB of the board, which is understood to be below FIG. 1A. Note the curved dashed line in FIG. 1A that indicates that many martial arts boards have a non-planar rear surface, due to the outer perimeter edges being the thickest portion of the board and the central region being of lesser thickness and/or having break joints. The front surface of martial arts boards are typically planar, represented by the front plane FP in FIG. 1A.

These preferred hand and forearm positions may be described as the hand/wrist being rotated into the position in FIG. 1A from the position of FIG. 1B, which for these figures is a counterclockwise rotation. Note that, in FIG. 1B, the knuckles K are behind the central plane and the rear surface of the board, and the heel H of the palm is pressed against the board and closer to the center region CB of the board.

The preferred position results in an angle between the main portion of the hand (and/or the palm) and the forearm is a large obtuse angle O1 and small supplementary angle A1. The inventors prefer an angle O1 of greater than or equal to 135 degrees and a corresponding supplementary angle A1 of equal to or less than 45 degrees. Possible ranges for the obtuse angle O1 may be, for example, 135-160 degrees, or especially about 135-155 degrees. Possible ranges for the acute angle A1 may be, for example, 45-20 degrees, or especially 45-25 degrees.

The Cannella sheath CAN-S and said prior art commercial product COMM, on the other hand, are adapted to hold the fingers, hand, and wrist in positions substantially similar to those portrayed by the bare-hand holding the board in FIG. 1B. When the Cannella CAN-S and commercial product COMM are used, as shown in FIGS. 2A and 3A, respectively, the fingers, hand, and wrist positions stay similar to those in FIG. 1B. FIGS. 2A and 3A show that the fingers inside the Cannella/commercial-product, up to about the proximal inter-phalangeal joint (that is, the distal phalanx and the middle phalanx), lie parallel to and close to the front plane FP and the central plane CP of the board/target.

When inside the Canella sheath CAN-S, as shown by FIG. 2A, the fingers' distal phalanx and the middle phalanx are parallel to the board, distanced evenly all along their lengths from the front surface of the board by spikes ("14" in Cannella) and by the thickness of the underside ("18" in Cannella) of the sheath. Note, too, in FIG. 2A, that the metacarpophalangeal joints (knuckles K) lie rearward of the central plane CP of the board. The palm lies tight against the rear surface of the board (see P2) and the wrist W is closer to the center of the board than in FIG. 1A. The angle O2 of the forearm to the palm is smaller than angle O1, for example, less than 135 degrees, and more typically in the range of about 110-134 degrees. The corresponding supplementary angle A2 in the Canella sheath, therefore, is greater than 45 degrees, and more typically in the range of about 70-46 degrees. Note that the board outer perimeter edge E region, which is typically the thickest region of a martial arts target board, is shown with front and rear surfaces parallel to each other, but the board may have a reduced thickness and/or curved rear surface nearer to the center of the board as shown by the curved line C.

The commercial product is likewise adapted so that the fingers, up to about the proximal inter-phalangeal joint (especially the distal phalanx and the middle phalanx), lie parallel to the front plane and the central plane of the board/target. In the commercial product COMM, as shown by FIG. 3A, the fingers' distal phalanx and middle phalanx are parallel to the board, distanced evenly from the front surface of the board, only by the thickness of the underside of the sheath. Note in FIG. 3A that the metacarpophalangeal joints (knuckles K) lie rearward of the central plane CP of the board. The palm lies tight against the rear surface of the board (see P3) and the angle of the forearm to the palm O3 and the supplementary angle A3 are the same or nearly the same as O2 and A2 of the sheath of the Cannella patent, described above.

In summary, the surface that the user's fingers rest on, inside these prior devices, is parallel to the board, requiring the holder's fingers distal and middle phalanx to lie flat/parallel relative to the board's front and central planes, and forcing the heel of the holder's palm toward the board and further in toward the center of the target. These features of the prior art devices increases the likelihood of "jamming" the holder's wrist(s) as a result of a kick/strike.

Further, the Cannella sheath is described as "made of a tough, substantially nondeformable, abrasion and cutting resistant material, such as plastic or metal". The prior art commercial product related to Cannella is advertised as being made of Lexan™ polycarbonate, which the inventors note is hard, rigid, completely-inflexible, and tends to become brittle over time making it more susceptible to breaking/shattering when struck. Also, as shown to best advantage in FIGS. 2B and 3B, both the Canella sheath and the commercial product comprise a flange FL (reference 28 in Cannella) that protrudes rearward from the sheath. This flange FL rests against the outer perimeter edge surface of the board to control and limit the position of the sheath on the board. This flange FL is believed by the inventors not only to limit the user's options for hand placement when holding the board, but also to increase the likelihood of breaker injury due to the introduction of rigid surfaces/edges into the target area.

Inadequate Gripping Surface:

Padded gloves commonly available in martial arts circles may protect the holder's fingers to some extent, and may provide a cushioned surface should the breaker hit the glove. However, even conventionally-padded, prior art martial arts gloves decrease the holder's grip, resulting in the target acting "slippery" and being difficult to hang on to. Gloves with increased padding would only interfere further with the holder's grip on the board. The result of padded gloves, therefore, is typically a reduced grip on the target, increasing the likelihood of dropping or prematurely releasing the board/target during the attempt and resulting in a missed attempt on the break.

Therefore, there is still a need for an improved device for finger protection in martial arts, and embodiments of the invention meet this need. Certain embodiments of the invention provide correct ergonomic positioning that is very different from the positioning encouraged by prior art sheaths. Also, certain embodiments of the invention provide the holder with multiple options for hand and protector placement on the board, while also providing a sure grip. Also, certain embodiments comprise firm, but non-injuring and slightly-compressible, elements and surfaces that provide a surprisingly effective balance of protecting/shielding the holder's hand/fingers and protecting the striker's foot and toes in the case of striking with the foot, or hands and fingers in the case of striking with the hand.

SUMMARY

Figure 1A:
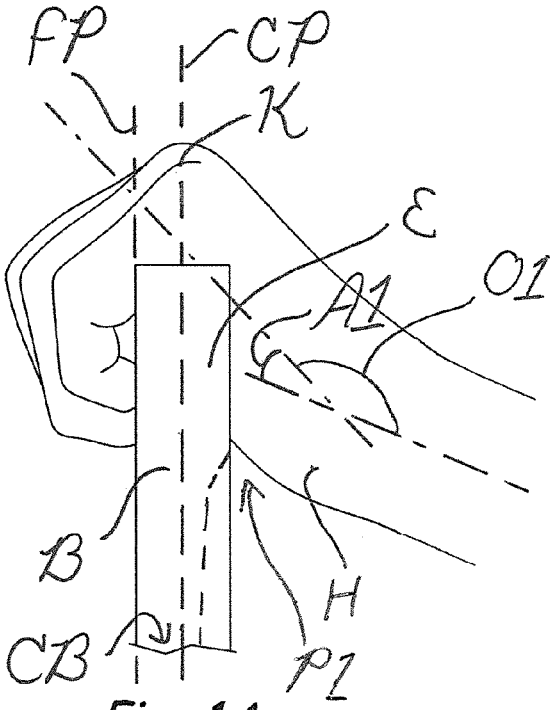
FIG. 1A is a side view of a holder grasping a martial arts board with his/her bare hand, with the hand rotated counterclockwise to an ergonomically-beneficial position.

The invention comprises a device for protecting the fingers, hand, and/or wrist of a person holding a board or other target that a martial artist attempts to hit or kick with a hand or foot. In this description and in the claims, the term "striker" is used as a broad term that may include both a person kicking a board and a person hitting with the hand or any body part. Said protection may be protection from direct impact, for example, kicking of the fingers, and/or from the force/shock that is transmitted rearward to the hand and wrists of the holder of the board/target.

The device comprises an enclosure for receiving and holding multiple of a board/target holder's fingers in a generally curled or other inwardly-slanted position, as the user grips/grasps the board/target between the device and the user's palm. The structure of the device, and especially a slanted floor of the enclosure, result in said curled or inwardly-slanted position for the fingers, which places the rest of the hand, the wrist, and forearm in ergonomic and safe positions. In certain embodiments, the device is made entirely or substantially of material(s) in a particular hardness range that protects the user's fingers but that also tends to prevent injury to the person hitting/kicking the board/target.

In certain embodiments, an interior space inside the device is adapted to receive the user's finger(s) so that the holder(s) may use two of the devices, one on each hand, to hold a board/target generally in front of or to the side of the holder(s) for presentation to the striker. The board is typically held generally vertical, for example for side-kicks, or at other angles, such as 5-45 degrees from vertical for other types of front or round kicks, or generally parallel to the floor (flat or almost flat) for ax kicks. Typically two holders are required or desired to hold a single board. Based on the orientation typically seen when the device is in use, structure behind the interior space rests on the board/target and structure in front of the interior space shield the fingers from direct impact. The rear portion of the device may comprise a rear wall, called in certain embodiments a "floor", against which the fingers press, and one or more extension members/surfaces that extend out rearwardly from the floor wall to lie on a rear plane of the device. Said one or more extension members/surfaces is/are sized and shaped so that, when the extension members/surfaces is/are placed against the front surface of the board/target, the device is so oriented that the rear wall/floor is at an angle to the front surface of the board/target.

In certain embodiments, the device is adapted to be adjustable in position on the board/target, to give the user flexibility in grasping different portions of the board/target. Preferably, the device comprises no protrusions extending rearward of said rear plane, particularly no plate or protrusion(s) that extend(s) along, around or behind the outer perimeter edge of the board/target. Such plate(s) or protrusion(s) could interfere or limit the placement of the device relative to the board, and, therefore, the preferred device (missing such plate(s) and protrusion(s)) may be moved inward relative to the outer perimeter edge.

Objects of certain embodiments of the invention, therefore, comprise implementing a protective device, for a martial arts' board/target holder's hands, that provide both impact and ergonomic benefits for the holder(s). Another object of certain embodiments is that employing such a device should not dramatically increase the likelihood of injury to the breaker compared to the breaker hitting/kicking a board/target that is held with bare hands and/or soft/flexible gloves.

DETAILED DESCRIPTION

Referring to the Figures, there are shown examples of bare hands holding a martial arts board, and also two prior art devices being used in holding a martial arts board. Also shown in the Figures is one, but not the only, embodiment of the invented, improved device for finger and/or hand and wrist protection in martial arts and methods of using the embodiment. Martial arts boards, including rebreakable boards, are well-known in the art.

Figure 1B:
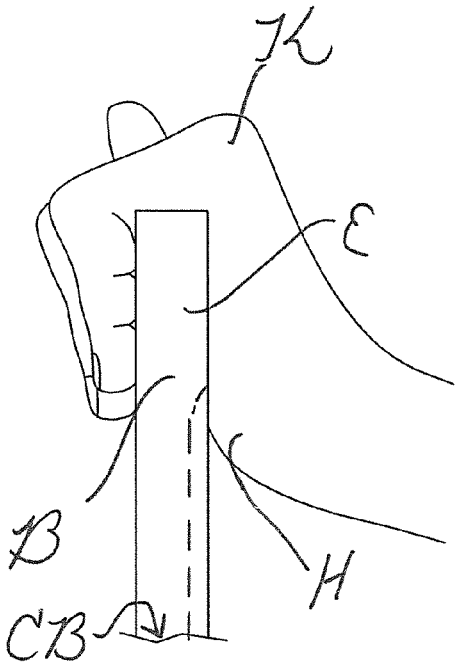
FIG. 1B is a side view of a holder grasping a martial arts board with his/her bare hand, with the hand rotated clockwise to a non-ergonomically-beneficial position.
Figure 4:
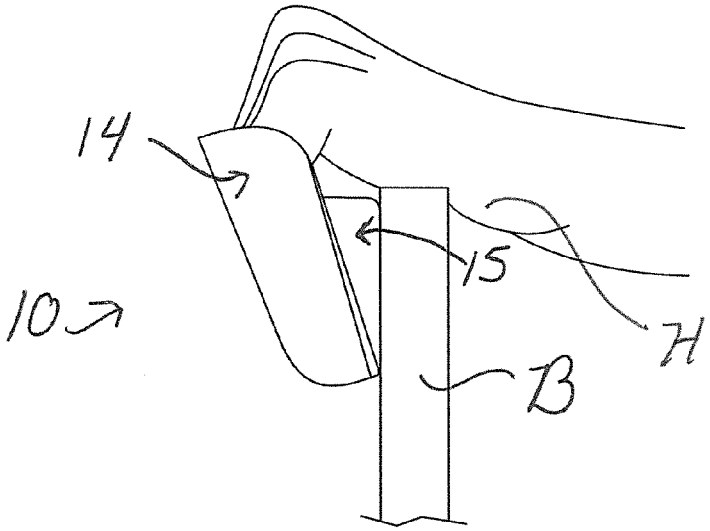
FIG. 4 is a side view of a holder using one embodiment of the invented protection device to hold a board.
Figure 2A:
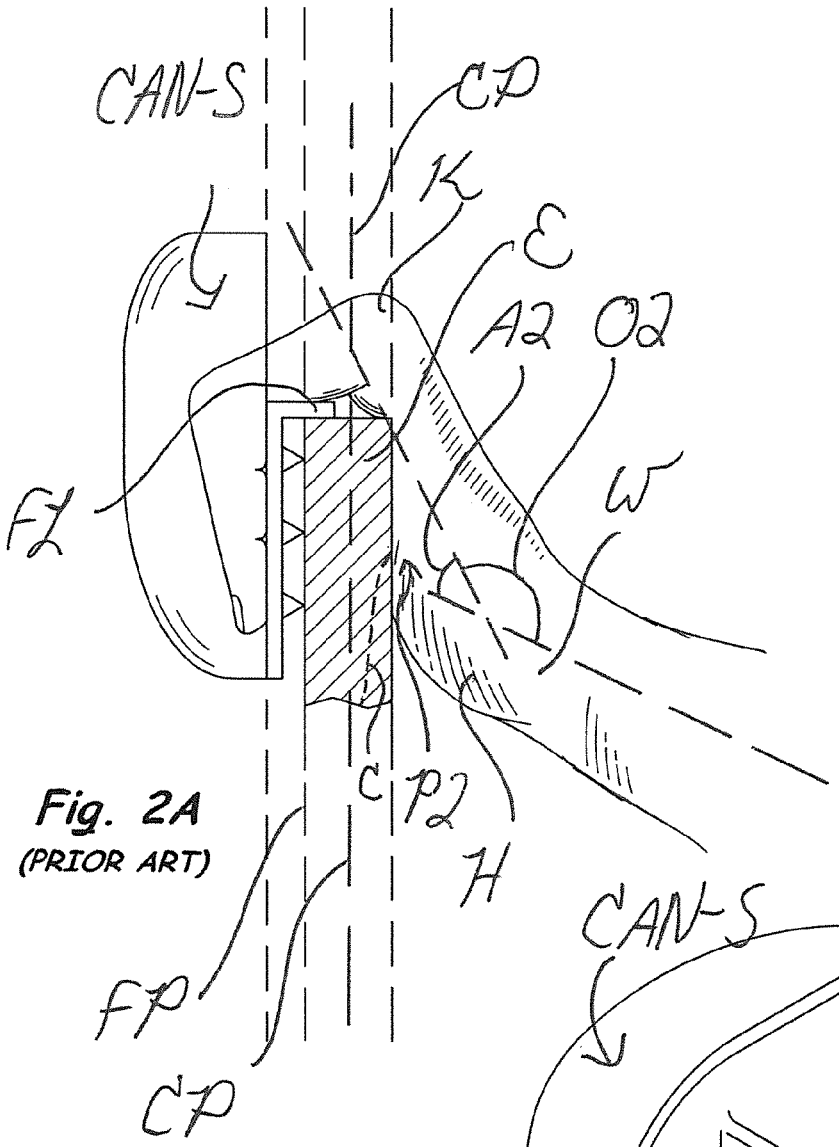
Fig. 2A (PRIOR ART)
FIG. 2A is a side view of a holder using a prior art sheath such as that disclosed in Canella, U.S. Pat. No. 4,807,302, to grasp a martial arts board, resulting in the hand being rotated clockwise in this figure.
Figure 2B:
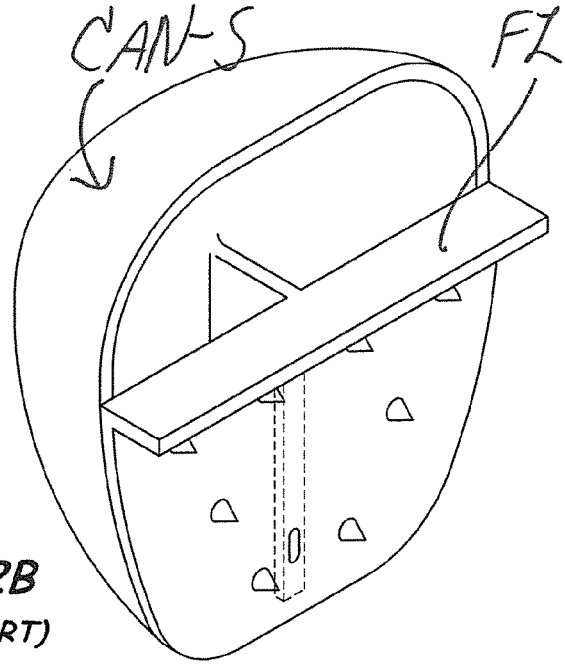
Fig. 2B (PRIOR ART)
FIG. 2B is a rear perspective view of the prior art sheath of FIG. 2A.
Figure 3A:
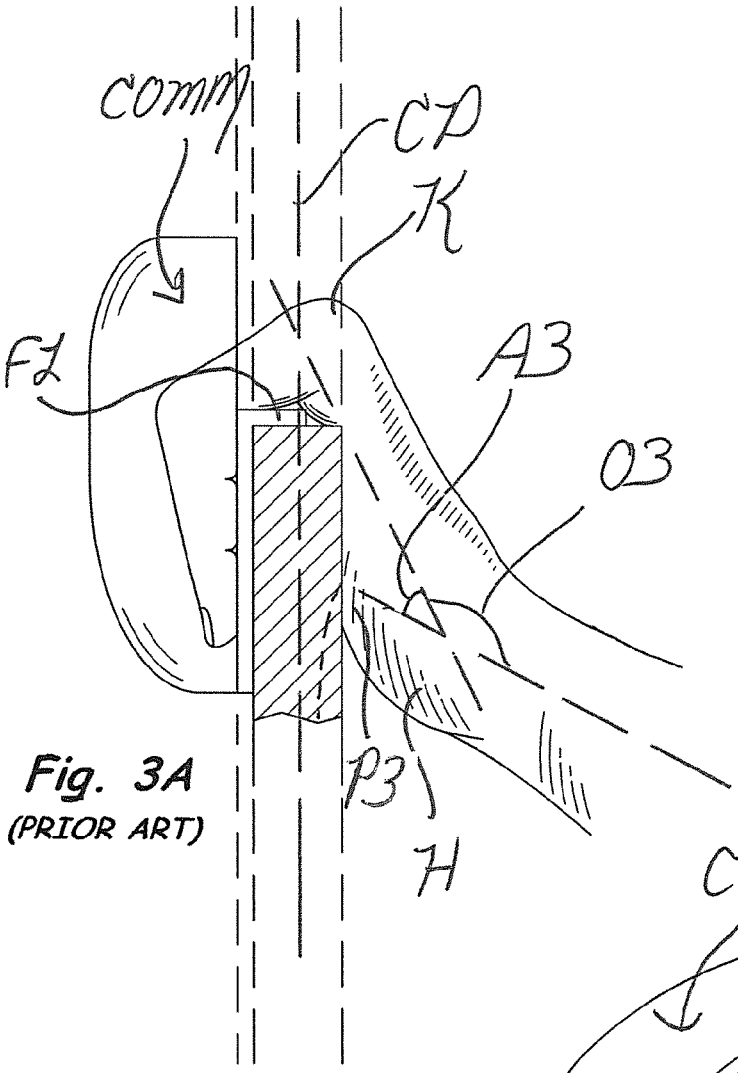
Fig. 3A (PRIOR ART)
FIG. 3A is a side view of a holder using a prior art commercial sheath similar to that disclosed in Canella, U.S. Pat. No. 4,807,302, to grasp a martial arts board, resulting in the hand being rotated clockwise in this figure.
Figure 3B:
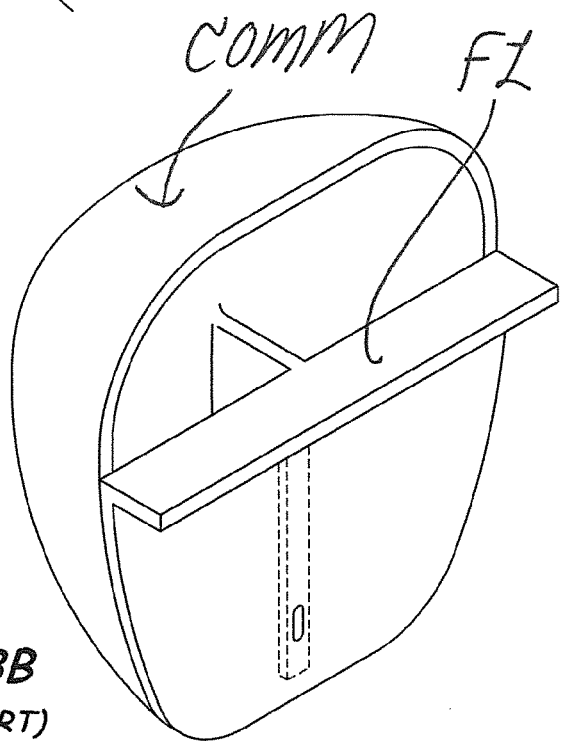
Fig. 3B (PRIOR ART)
FIG. 3B is a rear perspective view of the prior art commercial sheath of FIG. 3A.

Device 10 is representative of one, but not the only, embodiment of the invented device for finger protection in martial arts. FIG. 4 (on the same page as FIGS. 1A and 1B) and FIG. 6B show to best advantage examples of how the device 10 may be worn, and how the device 10 tends to cause the user's (holder's) hand to be rotated counterclockwise in FIG. 4 and clockwise in FIG. 6B, relative to the board B, compared to the un-ergonomic and possibly-injurious positions of FIGS. 1B, 2A, and 3A. One may see in FIGS. 4 and 6B that the distal portions of the fingers are curled/slanted, the knuckles are forward, and the wrist is straightened, compared to the prior art approaches.

Figure 6A:
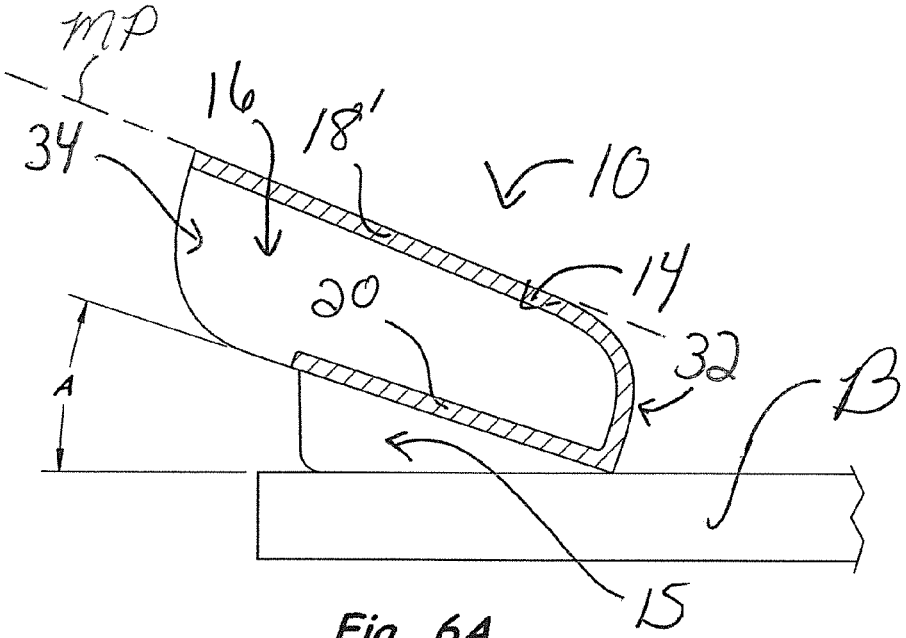
FIG. 6A is a partially-cross-sectional view of the device of FIG. 4 on a martial arts board, showing an example angle A of the floor of the finger compartment relative to the surface of the board.
Figure 6B:
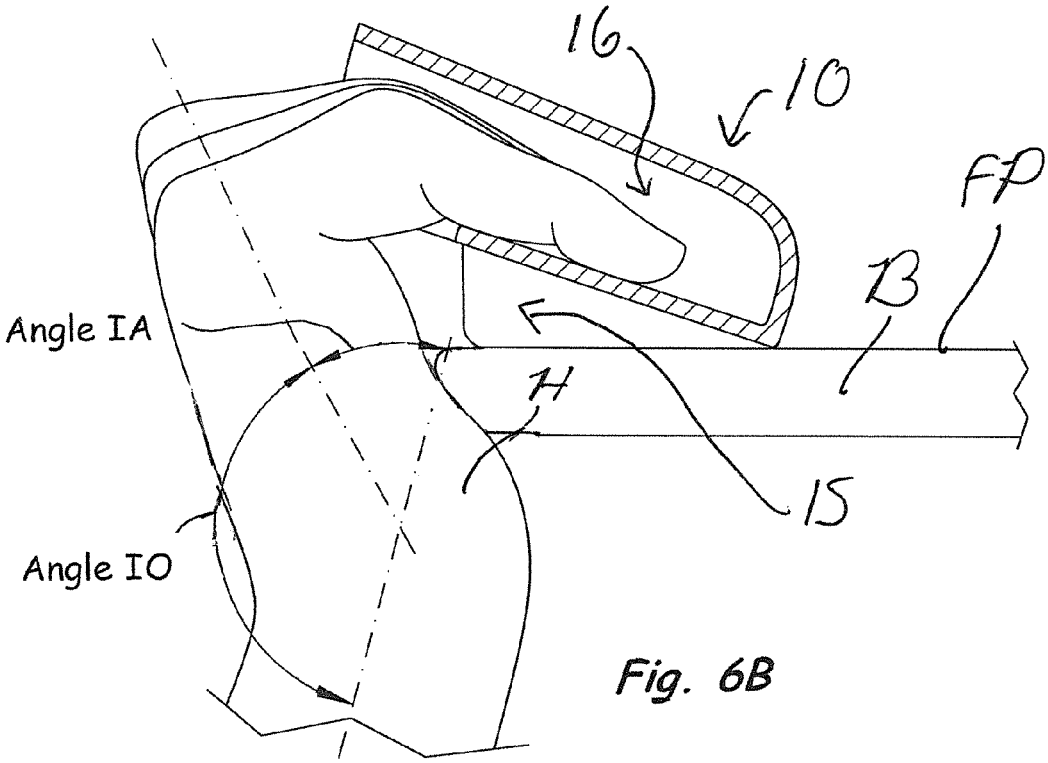
FIG. 6B shows the device and board of FIG. 6A in use by a holder's hand.
Figure 7:
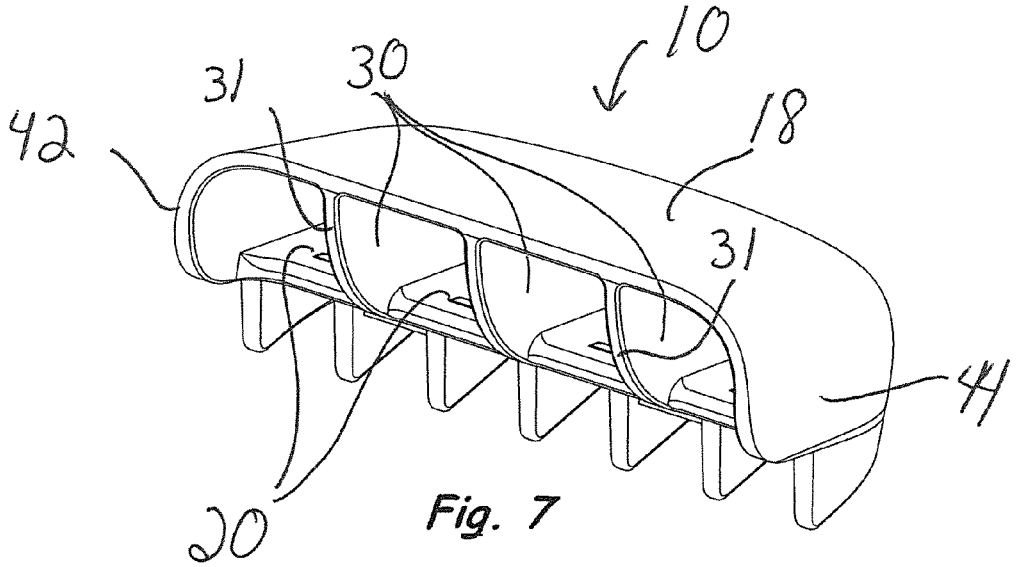
FIG. 7 is a rear perspective view of the device of FIG. 4.
Figure 8:
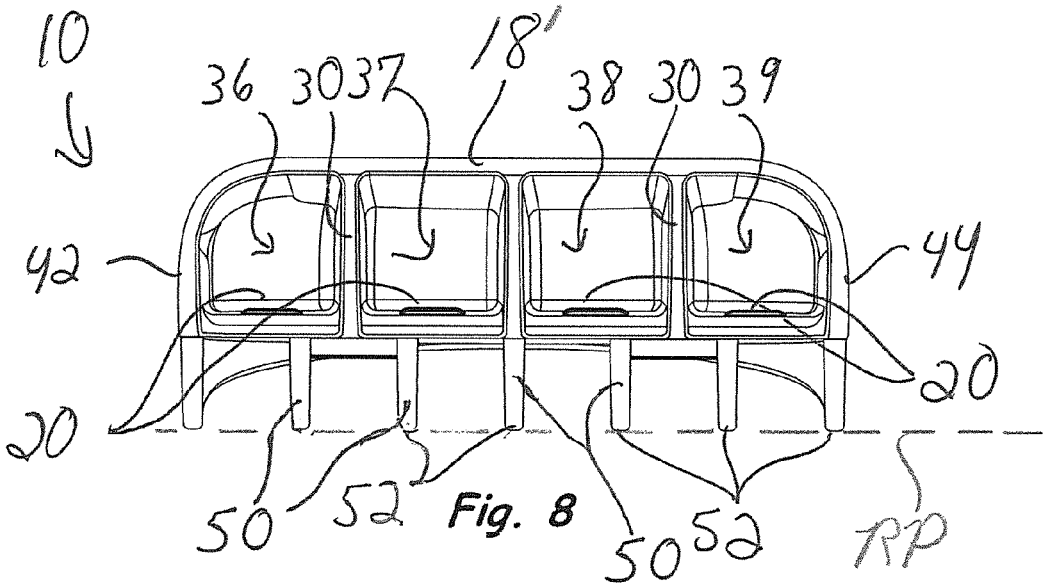
FIG. 8 is a rear view of the device of FIG. 4.
Figure 9:
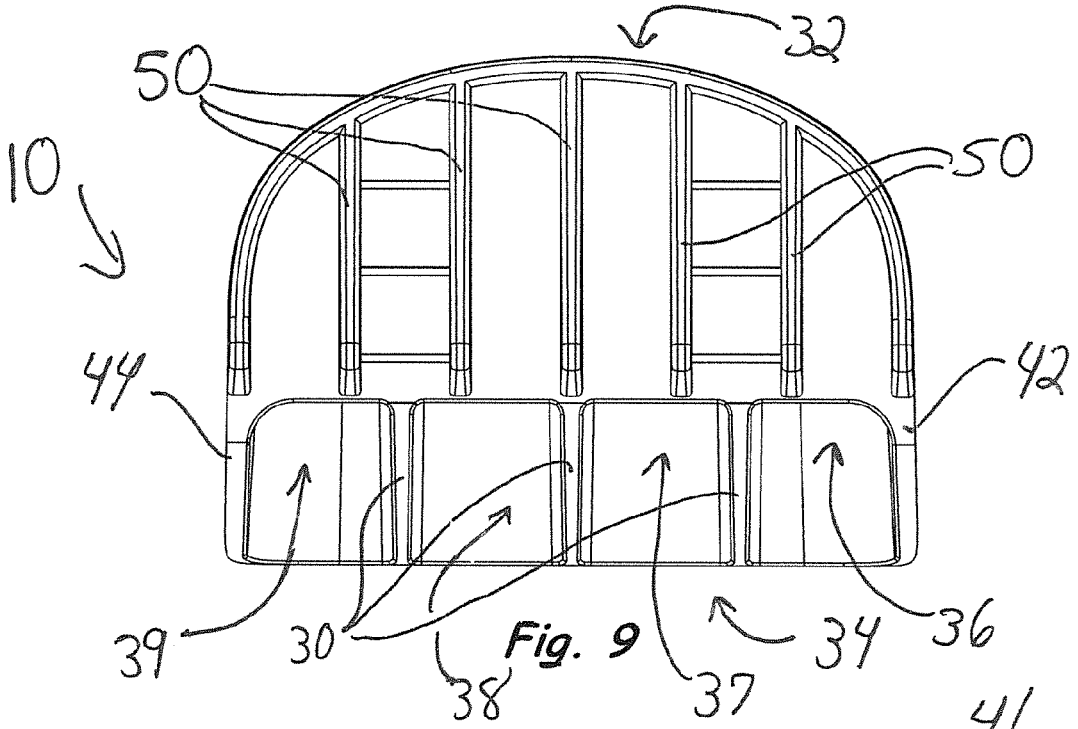
FIG. 9 is a bottom view of the device of FIG. 4.
Figure 10:
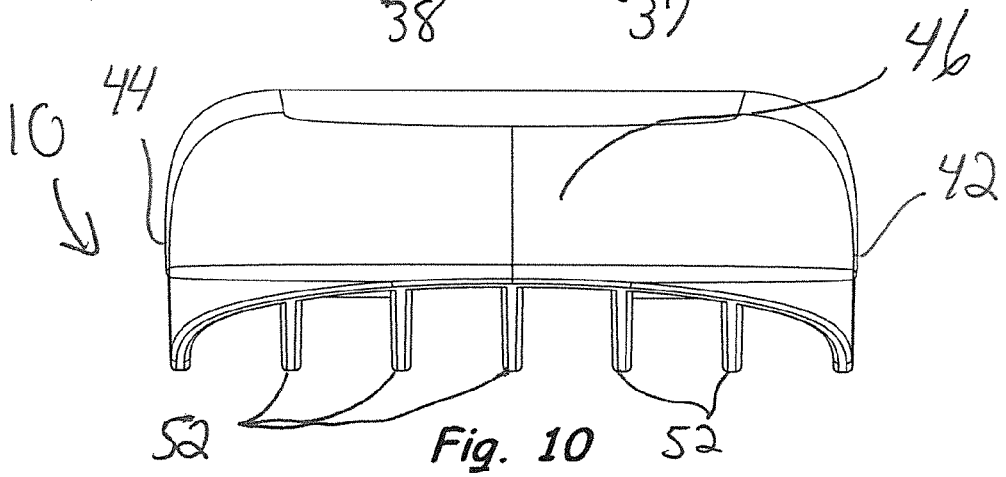
FIG. 10 is a perspective distal end view of the device of FIG. 4, that is, viewing the device as it is oriented in FIG. 11 from the right of FIG. 11.

As shown to best advantage in FIGS. 4 and 6A and B, device 10 is worn on the fingers of the holder's hand and is comprised of a enclosure 14 (or "finger compartment" or "pocket space") and a rear portion 15 that extends rearward (to the right in FIG. 4) to rest on and grip the board. The enclosure 14 surrounds multiple sides of an interior space, and hence defines the interior space 16 into which the user slides his/her fingers. The main walls forming the enclosure 14 are a curved front wall 18 and a floor wall ("floor") 20. The front wall 18 curves from side- to-side in front of (or "over") the interior space 16 and, hence, in front of the distal phalanx and the middle phalanx of the hand. The floor is a generally flat and planar wall that extends side to side behind (or "under") the interior space 16, and, hence, behind the distal phalanx and the middle phalanx.

As shown to best advantage in FIGS. 7-9 and 13, one or more dividers 30 are provided in the interior space 16, extending at least part of the way (and preferably all the way) between the closed end 32 and opening 34 of enclosure 14, and extending from the inner surface of the front wall 18 to the inner surface of the floor 20. Preferably three dividers are used, for creating four sub-compartments 36, 37, 38, and 39 (see FIGS. 8 and 9) of the interior space 16. These dividers 30 are walls that are transverse to the floor 20, serving to separate the holder's fingers received in the interior space 16 and to provide surfaces against which the fingers may push or otherwise apply force during holding the target and in reaction to a strike. The dividers therefore may play roles in the generally- evenly-spaced-apart fingers applying rearward force to the device by means of force spread-out across the floor, and applying sideways force to the device by means of force on one or more of the dividers. In addition, having four fingers separated in four small sub-compartments 36-39, helps in general with control of the device by the fingers/hand and in preventing the device from pivoting relative to the fingers or falling off the fingers. In addition, as emphasized schematically in FIG. 13, the dividers 30 and the sidewalls 42, 44 help spread-out the load of a strike, for example, transferring force from the top of the front wall 18, to the sidewalls 42, 44 and through the dividers 30 to the floor 20, and then to the bottom ends of the sidewalls 42, 44 and to the extensions 50, thus shielding the fingers and helping to prevent collapse of the enclosure 14.

Figure 12:
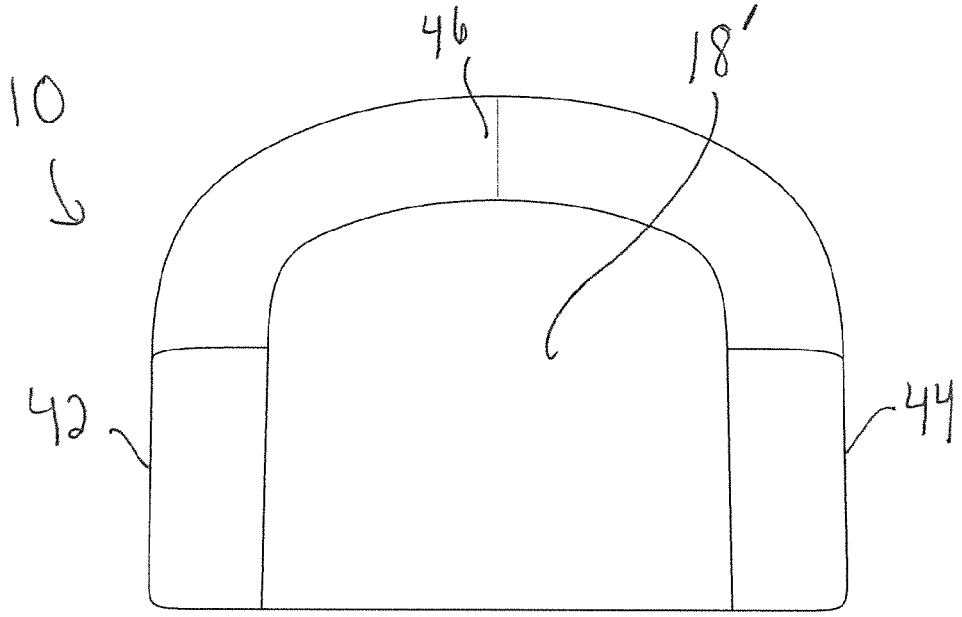
FIG. 12 is a top view of the device of FIG. 4.
Figure 13:
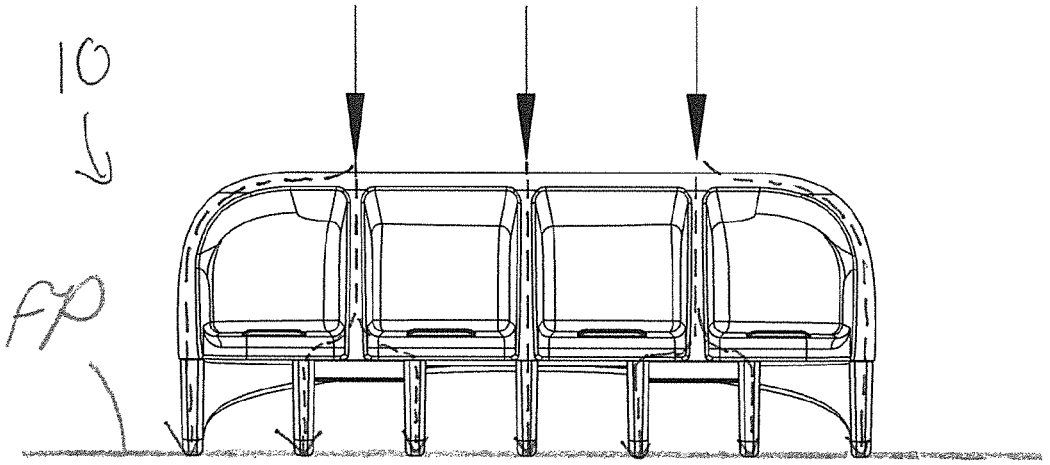
FIG. 13 is a rear view of the device of FIG. 4 illustrating force arrows so the viewed may note how the dividers of the finger compartment and the rearward extensions will transfer the force to the board (which would be below the device in this figure).

The floor 20 of the enclosure 14 connects, or is integrally attached to, the side wall portions 42, 44 of the front wall 18 and the distal portion 46 of the front wall. One may say the front wall 18 curves all the way to the floor 20 at two sides and at the distal end of the device, or one may say that the front wall 18 comprises sidewall portions 42, 44 and distal wall portion 46 that connect to the floor 20. The device's enclosure walls (18, 42, 44, 46, 20) are usually solid and continuous, but may optionally incorporate one or more openings for air ventilation. In FIG. 6A and 12, one may see the portion referred to as the main portion 18' or top portion of the front wall 18. This main portion 18' is a generally planar portion of the front wall 18, typically being a plane MP that is at an angle of about 30-40 degrees from the rear plane RP, for example, and/or at an angle of about 10-25 degrees from the plane of the rear wall (floor 20), for example.

Figure 11:
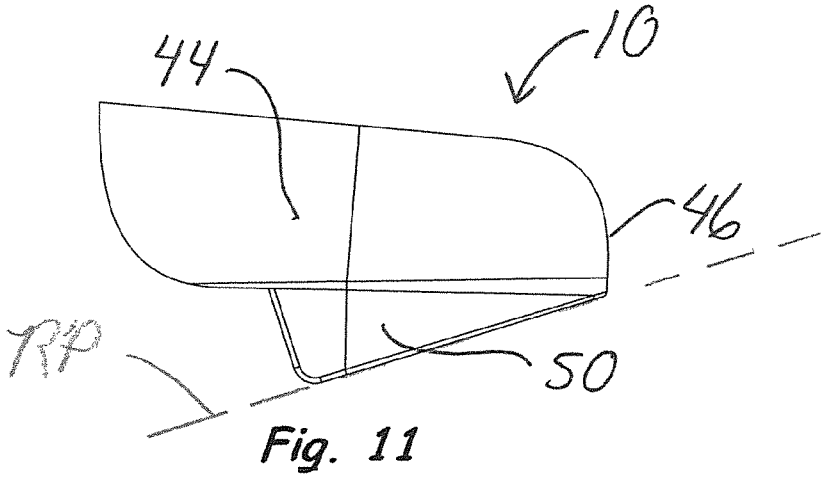
FIG. 11 is a side view of the device of FIG. 4, with the device rotated to make the floor wall generally horizontal.

Extending rearward from the enclosure 14 is at least one rear portion of the device, which, in device 10, takes the form of multiple protruding rearward extensions 50. These extensions 50 are generally transverse to the plane of the floor 20, so that they are generally parallel to the dividers 30 of the interior space. These extensions 50 each have a rear extremity that lies on the same plane, thus, defining a rear plane RP of the device (see FIGS. 8 and 11). The rear extremities of the extensions 50, in this embodiment, are rear edges 52 that all lie on the rear plane. Extensions 50 are longer, or in other words extend farther from the floor 20, at or near the proximal end of the device (opening 34), compared to their length at or near distal end of the device (closed end 32). The extensions 50 are generally triangular walls extending/protruding rearward from the floor of the enclosure. Thus, the extensions 50 hold the floor farther from the board B at the proximal/open end of the device than at the distal/closed end of the device, resulting in the floor 20 being at an angle A to said rear plane, as illustrated in FIG. 6A.

Thus, it may be said that, in certain embodiments, interior structure inside the device causes/urges the fingers to rest in said curled, inwardly-slanted, or other non-parallel position relative to the front plane and the central plane of the board/target. As shown in FIG. 6A, this may be done in certain embodiments by the surface against which the fingers rest being at an angle A to said rear plane of the rearmost extremity(ies), and hence at the same angle to the front surface of the board/target against which the rearmost extremity(ies) rest. In certain embodiments, angle A may be in the range of 5-45 degrees, for example, but the inventors have determined that angle A is more preferably between about 10-25 degrees, more preferably A is 16-20 degrees and especially-preferably angle A is about 18 degrees. With floor 20 being thus-angled or thus-slanted, the user can grasp the board/target securely between the device (with fingers inside) in front of the board/target, and the user's palm against or near the rear surface of the board/target, but the fingers are shielded, and the fingers, hand, wrist and forearm are in what the inventors refer to as "proper positions", that is, ergonomic, comfortable, and safe positions. Due to the strength needed to safely and effectively hold the board/target and the force with which the striker may kick/hit the board/target, these proper positions, further described below, may be matters of slight changes in position of the fingers, hand, wrist and/or forearm and/or their angles to each other.

FIG. 6B illustrates the finger, hand, and wrist positions of the holder when using device 10. This "proper holding position" comprises 1) the fingers being "curled" or otherwise slanting toward the board, which appears as slanting downward in this view; 2) the metacarpophalangeal joints ("knuckles" K) of the hand being generally aligned with (closely adjacent and generally centered over) the outer perimeter edge E and central plane of the board/target; and 3) the wrist angle IO (palm to forearm) being greater than or equal to 135 degrees, for example, about 135-160 degrees, or especially about 135-155 degrees, and corresponding supplementary angles IA being less than or equal to 45 degrees, or 45-20 degrees, or especially 45-25 degrees.

Figure 5A:
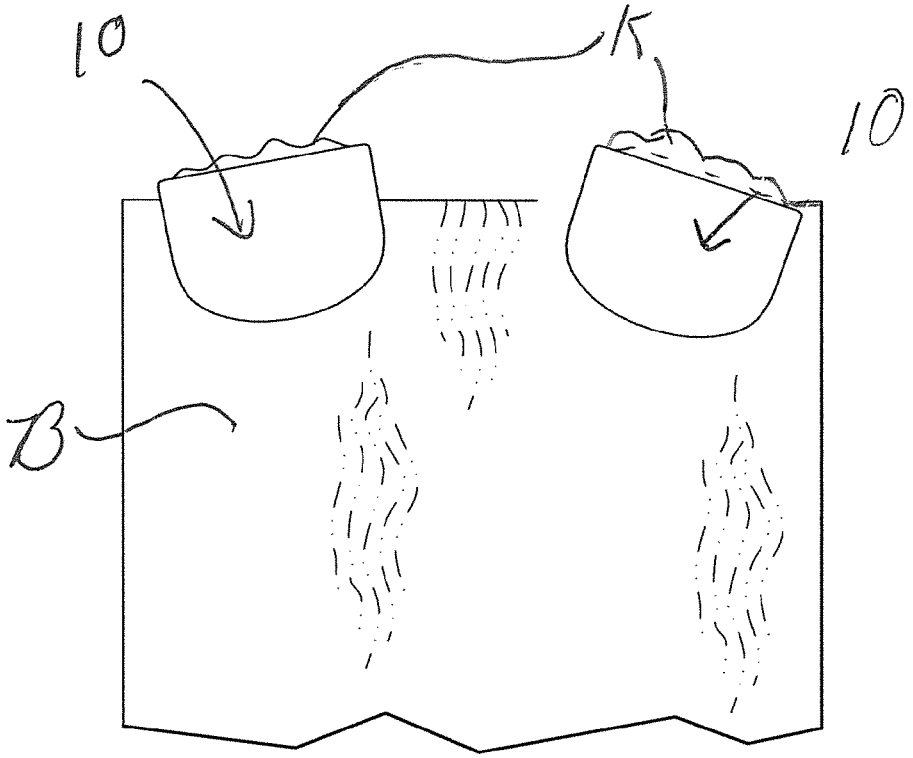
FIG. 5A is a schematic front view of two of the protection device embodiments of FIG. 4 being used by a holder in right and left hands to grasp a martial arts board, wherein the devices and the holder's hands are at angles to the top edge of the board that is being grasped.
Figure 5B:
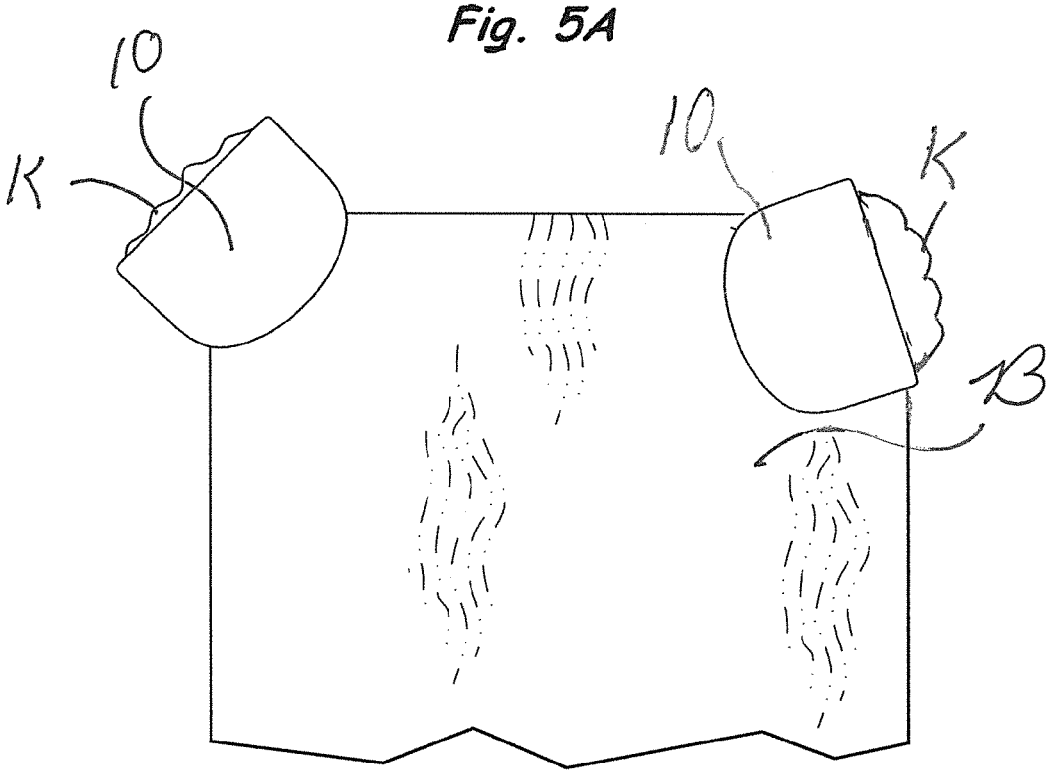
FIG. 5B is a schematic front view of two of the protection device embodiments of FIG. 4 being used by a holder in right and left hands to grasp a martial arts board, wherein the devices and the holder's hands are at the corners of the board at angles greater than in FIG. 5A to the top edge of the board.

It will be understand that one, or more commonly two, holders cooperate to hold a single board/target. The two holders will each grasp opposite edges of the board in their two hands. The device 10 allows the holder's hands to cup and grip the board at any point on or near the board's edge including corners, and at various angles relative to the board edge, as shown in FIGS. 5A and 5B for one holder. The device 10 does not require seating of any flange or other limiting structure against the board's edge E and the device can be moved inward relative to the edge E, if desired. This flexibility in placement allows the holders the most comfortable and secure grip on the board.

Semi-Rigidity:

Certain embodiments of the device are made of a semi-rigid material that resists collapse/crush from the initial impact force of the strike, including hits, blows, or kicks, yet is somewhat pliable so the breaker's hand/foot will encounter a slightly-yielding surface and be less susceptible to injury. The inventors believe that too-rigid materials may injure the striker and/or may become brittle over time making it more likely to fracture and cause injury to the kicker/striker and/or the holder, while too-flexible materials may allow injury of the holder. The material employed preferably also incorporates a certain amount of "stickiness" to promote a measure of grip and skid resistance for both the holder's fingers/hand inside the device, as well as that portion of the device's surface that contacts the board. The material preferably also provides some level of elasticity to accommodate varying hand sizes. A variety of materials or mixes may create such properties, with the especially preferred material(s) exhibiting a durometer measurement from about 50 A to about 90 A on the Shore Hardness scale, and more preferably from 65 A to about 85 A. 85 A Shore Hardness is currently the especially-preferred hardness. These ranges of Shore Hardness Scale A, and particularly a hardness equal to, or about, 85 A Shore Hardness are particularly important in certain embodiments, to provide the desired balance between protection of the holder and protection of the kicker/striker. For example, 35 A Shore Hardness in many embodiments has been found by the inventors to be too flexible and soft, while 92 A Shore Hardness in many embodiments has been found by the inventors to be too rigid and hard. Examples of effective materials are thermoplastic elastomers, and especially thermoplastic vulcanizates (TPVs) such as Santoprene™, that are preferably in the 65-85 A Shore Hardness range. The overall outer shape of certain embodiments that use such semi-rigid material(s) as those described herein can be many different geometries, with the preferred embodiment using a rounded, domed, or "flattened dome", such as device 10, to minimize tearing or cutting injuries to the breaker.

Angled Ergonomic Base:

Certain embodiments of the device use what may be called "an angled base" to support proper hand/wrist position when holding the target, as this is particularly important at the time of impact of the kicker's/striker's foot/hand against the board. This angled base holds the device so that the rear wall/floor of the finger compartment/interior space of the device is at an angle A to the board/target. Given the geometry of a human hand, the angle A of the rear wall/floor encourages the holder to place the heels of their hands nearer to the outer perimeter of the board/target as opposed to the inner or more central region of the board/target. As discussed above, the heel of the user's hand, when using certain embodiments of the invention, may actually be rearwardly-distanced from the rear surface of the board, due to the preferred "rotation" of the hand, as discussed above.

The rear portion of the device, which in device 10 comprise rearward extensions 50, may take various forms that rest on the board/target to position the device in front of the board/target and to place the rear wall/floor at the desired angle. The rear portion may be other arrangements and numbers of plates, protrusions, or other supporting structure, for example, a single or a plurality of solid or hollow structures having a rearward extremity(ies) that contact the board/target sufficiently to stabilize the device against the board/target. Those rear portion rearward extensions or other supporting structure(s) may be in the shape of triangular fins as in the preferred embodiment or can be in the shape of pyramids, pillars or other such geometric shapes such as honeycombed cells. The extension(s)/supporting-structure(s) may be symmetrical or asymmetrical, with the preferred embodiment using multiple triangular walls (hence, "tapered" from one end to the other) that are parallel to each other.

Load Transference:

The interior space of the device is preferably divided into multiple sections/portions. The device may use single or multiple dividers equally or unequally spaced across the compartment. Those dividers may be parallel with the device's sidewalls, or may employ a non-parallel orientation such as in a radiating fan shape. In the preferred configuration, the finger compartment is divided into four sections, with three dividers providing load support to transfer the breaker's force from the device's top/outer plate (the frontmost extremity of the front wall) to the rear wall/floor and then to the rear portion/extensions of the device that are in contact with the board. Such dividers also provide a gripping surface for the holder's fingers. The divider(s) may be curved at their proximal edges 31, as in device 10, to minimize the chance of pinching or scissoring the holder's fingers against the board surface.

It may be noted from the drawings, that the center divider 30 of device 10 is coplanar with the central extension 50 and that the sidewalls (sidewall portions 42, 44) are coplanar with the outermost extensions 50. These features may enhance load transference in certain embodiments. It may also be noted that the other dividers, that is, the dividers directly adjacent to center divider are parallel but not coplanar with any extensions. Thus, it may be said that some of the dividers 30 are co-planar with the extensions 50 while some are not. Alternatively, the dividers may be other shapes and arrangements in certain embodiments. Each divider may be solid, planar, and continuous, such as shown in device 10, to maximize support and load transference, or alternatively may employ one or more holes, openings, ribs or reinforcements, for appearance and/or to enhance the divider's role in transferring the force through the device to the board and/or otherwise protecting the user's hand. It may also be notes that the extensions 50 may be other shapes than those drawn, for example, arches.

Figure 14:
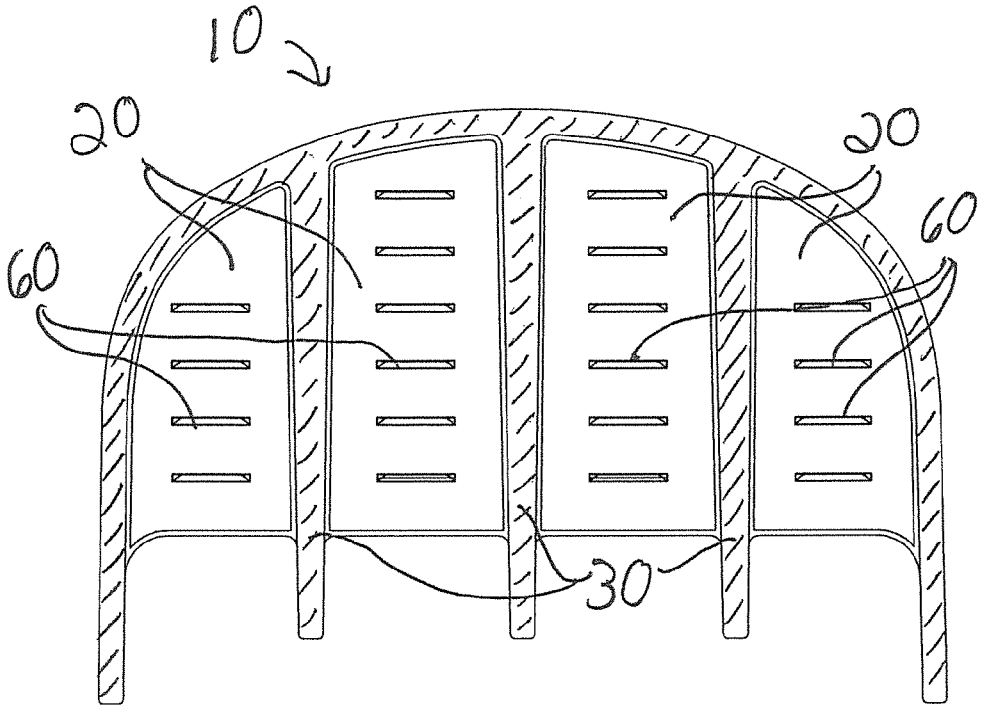
FIG. 14 is a cross-sectional view of the device of FIG. 4, viewed along the line 14-14 in FIG. 13.
Figure 15:
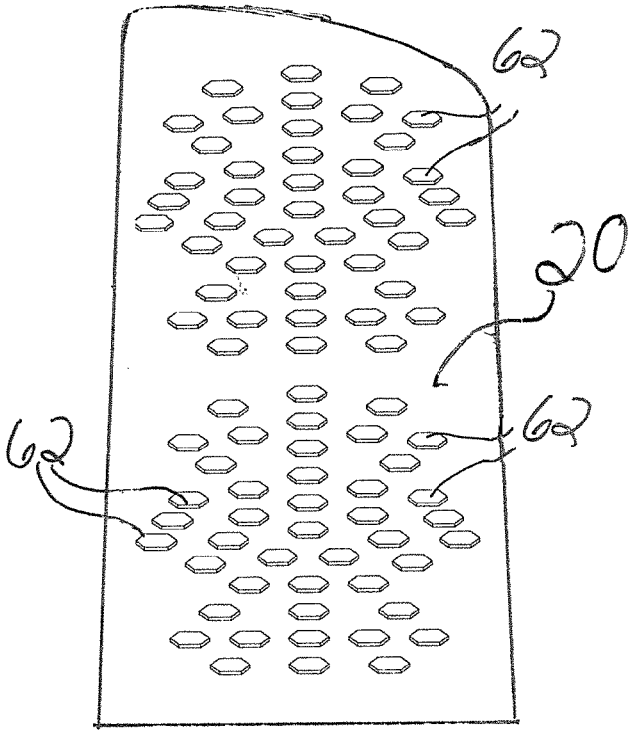
FIG. 15 is a partial view of an alternative floor wall, specifically a section of a floor wall between two dividers, showing an alternative texture embodiment.

The device's floor 20 may be either smooth or feature raised protrusions or other texture to enhance grip and inhibit slip. As illustrated in FIG. 14, certain embodiments use elongated ribs 60 that extend transversely to the dividers 30, which ribs have been found to be excellent structures for the fingertips to engage/grip. Alternatively, ribs in a chevron or herringbone pattern, for example, may be excellent engagement/gripping structures. Other protrusions/texture may be used in certain embodiments, for example, geometric shapes such as hemispherical domes, protruding squares or protruding hexagonal piers 62. Alternatively, the device may have texturing (like a roughened or bead-blasted surface, gunstock checkering or cross-hatching) on selected areas to improve the user's grip on the device, or more typically, the device's grip on the board. This texturing can also be added in other areas of the device for aesthetics and appearance or styling.

It should be noted that the terms "front" and "rear" are for convenience in describing various aspects of the protector device and are not necessarily intended to limit the use of the protector device to particular orientations.

Certain embodiments may be described as a protection device for use by a user grasping a martial arts board, the device comprising: an enclosure surrounding and defining an interior space, the enclosure having a front wall for receiving an impact from a martial arts striker (those impacting the board with hand, foot, or any body part) an opposing rear wall, and an open end for receiving distal portions of the fingers of the user in the interior space between the front wall and the rear wall so that the distal portions of the fingers push on the rear wall for grasping the board between the device and the palm of the user's hand; and the device further comprising at least one extension member extending from the enclosure and comprising a rearmost extremity for resting on a front surface of the martial arts board, said rearmost extremity being on, and defining, a rear plane parallel to the front surface of the board; wherein said rear wall is at an angle to said rear plane so that the fingers are at an angle to the front surface of the board. The at least one extension member may comprise a triangular wall perpendicular to the rear wall and having a rearmost edge that is the rearmost extremity on the rear plane. Or, the at least one extension member may comprise multiple, parallel triangular walls that are perpendicular to the rear wall and that each have a rearmost edge on the rear plane. The angle of the rear wall to the rear plane may be in the range of 5-45 degrees, for example, but more preferably is in the range of 16-20 degrees, and most preferably about 18 degrees for example, 17-19 degrees. The interior space is preferably divided into four sub-compartments by three dividing walls that are perpendicular to the rear wall, the four sub-compartments being for receiving four of said fingers. The front wall, the entire enclosure, or the entire protective device may be material characterized by having a Shore Hardness in the range of 65 A to 90 A, or more preferably about 85 A, for example. The front wall may have a planar main portion that is at an angle to the rear wall. The device may include no structure that extends rearward from said rear plane, for example, to enhance the options for placement on the board.

Certain embodiments may be described as a system for use in martial arts striking competition or practice, the system comprising a martial arts board having a front surface and a rear surface and an outer perimeter edge; and a finger protective device comprising: an enclosure surrounding and defining an interior space, the enclosure having a front wall for receiving an impact from a martial arts striker, an opposing rear wall, and an open end for receiving the user's fingers into the interior space; and at least one extension member extending rearward from the enclosure and comprising a rearmost extremity defining a rear plane, wherein the rearmost extremity is placed on the front surface of the board at or near the outer perimeter edge, with the rear plane being parallel to the front surface of the board, for the user to grasp the board between the device and the palm of the user's hand placed behind the board; wherein said rear wall is at an angle in the range of 5-45 degrees to said rear plane, so that the user's fingers resting on the rear wall are at an angle to the rear plane and to the front surface of the board; and wherein at least said enclosure is made of material having a Shore Hardness in the range of 65 A to 90 A. The angle of the rear wall to the rear plane may be in the range 16-20 degrees, or more preferably about 18 degrees, for example. The at least one extension member may comprise multiple, parallel triangular walls that are perpendicular to the rear wall and that each have a rearmost edge on the rear plane. The interior space may be divided into four sub-compartments by three dividing walls that are perpendicular to the rear wall, the four sub-compartments being for receiving four of said fingers. In certain embodiments, the front wall, the entire enclosure, or the entire protective device may be made from material characterized by having a Shore Hardness in the range of about 65 A to 90 A, for example, or more preferably about 85 A. The front wall may have a planar main portion that is at an angle to the rear wall. In certain embodiments, the device comprises no structure that extends rearward from said rear plane, to enhance the options for placement of the device on the board.

Certain embodiments may be described as a finger protector for holding a martial arts board, the protector being adapted for receiving distal portions of fingers of a user, and the protector comprising a front wall for receiving an impact from a striker of the board, a rear wall for being pressed-on by the fingers or fingertips of said fingers, and a rear portion for resting on the martial arts board, wherein the rear wall is at an angle, to the rearmost plane of the rear portion and also to the front surface of the board, in the range of 5-45 degrees, to cause the user's hand to rotate forward relative to the board when grasping the board between the device and the user's palm, for placing the user's hand and wrist in an improved ergonomic position for increased safety. The finger protector may be made of material characterized by having a Shore Hardness in the range of 65 A to 90 A, for example, or most preferably about 85 A. In certain embodiments, the device comprises no structure that extends rearward from said rear plane, to enhance the options for placement of the device on the board.

Although this invention has been described above with reference to particular means, materials and embodiments, it is to be understood that the invention is not limited to these disclosed particulars, but extends instead to all equivalents within the scope of the following claims.

The invention claimed is:

1. A protection device for use by a user grasping a martial arts board, the device comprising:

an enclosure surrounding and defining an interior space, the enclosure having a front wall for receiving an impact from a martial arts striker, an opposing rear wall, and an open end for receiving distal portions of fingers of the user in the interior space between the front wall and the rear wall so that the distal portions of the fingers push on the rear wall for grasping the board between the device and the palm of the user's hand; and the device further comprising at least one extension member extending from the enclosure and comprising a rearmost extremity for resting on a front surface of the martial arts board, said rearmost extremity being on, and defining, a rear plane parallel to the front surface of the board;

wherein said rear wall is at a slanted angle to said rear plane so that the fingers are at a slanted angle to the front surface of the board; and wherein the at least one extension member comprises multiple, parallel triangular walls that are perpendicular to the rear wall and that each have a rearmost edge on the rear plane.

2. The protection device as in claim 1, wherein the angle of the rear wall to the rear plane is in the range of 5-45 degrees.

3. The protection device as in claim 1, wherein the angle of the rear wall to the rear plane is in the range 16-20 degrees.

4. The protection device as in claim 1, wherein the interior space is divided into four sub-compartments by three dividing walls that are perpendicular to the rear wall, the four sub-compartments being for receiving four of said fingers.

5. The protection device as in claim 1, wherein the front wall is material characterized by having a Shore Hardness in the range of 65 A to 90 A.

6. The protection device as in claim 1, wherein the front wall is material characterized by having a Shore Hardness of about 85 A.

7. The protection device as in claim 1, wherein the entire device is material characterized by having a Shore Hardness in the range of 65 A to 90 A.

8. The protection device as in claim 1, wherein entire device is material characterized by having a Shore Hardness in the range of about 85 A.

9. The protection device as in claim 1, wherein the front wall has a planar main portion that is at an angle to the rear wall.

10. The protection device as in claim 1, wherein the device comprises no structure that extends rearward from said rear plane.

11. A system for use in martial arts striking competition or practice, the system comprising:

a martial arts board having a front surface and a rear surface and an outer perimeter edge; and a finger protective device comprising:

an enclosure surrounding and defining an interior space, the enclosure having a front wall for receiving an impact from a martial arts striker, an opposing rear wall, and an open end for receiving a user's fingers into the interior space; and at least one extension member extending rearward from the enclosure and comprising a rearmost extremity defining a rear plane, wherein the rearmost extremity is placed on the front surface of the board at or near the outer perimeter edge, with the rear plane being parallel to the front surface of the board, for the user to grasp the board between the device and the palm of the user's hand placed behind the board;

wherein :

said rear wall is at an angle in the range of 5-45 degrees to said rear plane, so that the user's fingers resting on the rear wall are at an angle to the rear plane and to the front surface of the board; and at least said enclosure is made of material having a Shore Hardness in the range of 65 A to 90 A; and the protective device comprises no structure that extends rearward from said rear plane.

12. The system as in claim 11, wherein the angle of the rear wall to the rear plane is in the range 16-20 degrees.

13. The system as in claim 11, wherein the at least one extension member comprises multiple, parallel triangular walls that are perpendicular to the rear wall and that each have a rearmost edge on the rear plane.

14. The system as in claim 11, wherein the interior space is divided into four sub-compartments by three dividing walls that are perpendicular to the rear wall, the four sub-compartments being for receiving four of said fingers.

15. The system as in claim 11, wherein the entire device is material characterized by having a Shore Hardness in the range of 65 A to 90 A.

16. The system as in claim 11, wherein the entire device is material characterized by having a Shore Hardness of about 85 A.

17. The system as in claim 11, wherein the front wall has a planar main portion that is at an angle to the rear wall.

* * * * *